US010023441B2

(12) United States Patent
Meyer

(10) Patent No.: US 10,023,441 B2
(45) Date of Patent: Jul. 17, 2018

(54) GRIPPING DEVICE FOR HANDLING REINFORCEMENT CAGES FOR TOWER SEGMENTS OF A WIND TURBINE

(71) Applicant: Wobben Properties GmbH, Aurich (DE)

(72) Inventor: Ingo Meyer, Wiesmoor (DE)

(73) Assignee: WOBBEN PROPERTIES GMBH, Aurich (DE)

( * ) Notice: Subject to any disclaimer, the term of this patent is extended or adjusted under 35 U.S.C. 154(b) by 262 days.

(21) Appl. No.: 14/646,314

(22) PCT Filed: Oct. 14, 2013

(86) PCT No.: PCT/EP2013/071427
§ 371 (c)(1),
(2) Date: May 20, 2015

(87) PCT Pub. No.: WO2014/079628
PCT Pub. Date: May 30, 2014

(65) Prior Publication Data

US 2015/0314994 A1 Nov. 5, 2015

(30) Foreign Application Priority Data

Nov. 23, 2012 (DE) ..... 10 2012 221 453

(51) Int. Cl.
*B66C 1/42* (2006.01)
*B66C 1/10* (2006.01)
*B21F 27/12* (2006.01)

(52) U.S. Cl.
CPC ..... *B66C 1/108* (2013.01); *B21F 27/12* (2013.01); *B66C 1/42* (2013.01)

(58) Field of Classification Search
CPC ..... B28B 21/56; B28B 21/58; B28B 21/60; B28B 21/62; B28B 21/68; B28B 21/90;
(Continued)

(56) References Cited

U.S. PATENT DOCUMENTS 1,810,583 A 6/1931 Tuerck
2,642,307 A 6/1953 Olson
(Continued)

FOREIGN PATENT DOCUMENTS

CN 201890706 U 7/2011
CN 102602793 A 7/2012
(Continued)

*Primary Examiner* — Anna M Momper
*Assistant Examiner* — Brendan P Tighe
(74) *Attorney, Agent, or Firm* — Seed Intellectual Property Law Group LLP

(57) ABSTRACT

A gripping device for handling reinforcement cages for tower segments of a wind turbine, comprising a gripper arm holding fixture and multiple gripper arms arranged radially on the gripper arm holding fixture. In particular, it is proposed that there is a coupling mechanism that can be connected with the reinforcement cage on each gripper arm, the length of the gripper arms can be telescopically motor-adjusted, the gripping device can be coupled with a lifting device that can be moved horizontally and vertically, and is adapted to move a reinforcement cage from apparatus for manufacturing reinforcement cages and/or to put a reinforcement cage down in a casing for creating a tower segment.

18 Claims, 10 Drawing Sheets

(58) Field of Classification Search
CPC ..... B28B 21/905; B66C 1/108; B66C 1/425; B66C 1/427; B66C 1/445; B66C 1/447; B66C 1/48; B66C 1/485; B66C 1/54; B66C 1/56; B66C 1/62; B66C 1/625; B66C 1/66; Y10S 294/901; Y10S 294/902; Y10S 294/907
USPC ..... 74/160; 294/67.33, 81.21, 81.54, 81.62, 294/90, 119.1, 207; 414/451, 910, 911
See application file for complete search history.

(56) References Cited

U.S. PATENT DOCUMENTS

| | | | | |
|---|---|---|---|---|
| 3,076,673 | A * | 2/1963 | Kaplan | B66C 1/32 294/119.1 |
| 5,306,062 | A | 4/1994 | Dodge | |
| 5,476,300 | A | 12/1995 | Dodge | |
| 5,671,962 | A * | 9/1997 | Otsuka | B25J 9/1612 294/119.1 |
| 5,762,391 | A * | 6/1998 | Sumnitsch | B25J 15/028 294/119.1 |
| 6,249,591 | B1 * | 6/2001 | Tullis | G01D 5/305 382/106 |
| 9,016,487 | B2 | 4/2015 | Kameyama | |
| 2010/0127824 | A1 * | 5/2010 | Moschl | G05B 19/4184 340/5.65 |
| 2012/0175903 | A1 * | 7/2012 | Murakami | B25J 15/026 294/207 |
| 2012/0242101 | A1 | 9/2012 | Stroh | |

FOREIGN PATENT DOCUMENTS

| | | | |
|---|---|---|---|
| DE | 29 29 035 | C2 | 8/1983 |
| DE | 295 16 996 | U1 | 5/1996 |
| DE | 20 2010 008 450 | U1 | 1/2012 |
| JP | 2012121665 | A | 6/2012 |
| SU | 850552 | A1 | 7/1981 |
| SU | 1085925 | A1 | 4/1984 |
| TW | 358082 | | 5/1999 |
| TW | M283844 | U | 12/2005 |

* cited by examiner

GRIPPING DEVICE FOR HANDLING REINFORCEMENT CAGES FOR TOWER SEGMENTS OF A WIND TURBINE

BACKGROUND

Technical Field

This invention relates to a gripping device for handling reinforcement cages for tower segments of a wind turbine.

Description of the Related Art

Towers of the kind used for wind turbines, amongst other things, often have a wall made of concrete or reinforced concrete. Especially in the case of towers that are subject to dynamic forces, which applies to most towers due to the wind, additional strengthening structures called reinforcement cages are used on the inside of the tower wall to improve stability. Such towers have a segmented design, i.e., a tower is built with several, essentially ring-shaped tower segments placed on top of each other.

At this point, the following documents are generally pointed out as prior art: DE 29 29 035 C2, DE 295 16 996 U1, DE 20 2010 008 450 U1, U.S. Pat. No. 5,306,062A and U.S. Pat. No. 1,810,583A.

During the manufacturing of such tower segments, first of all the reinforcement cage is manufactured and then it is surrounded by concrete filled into purpose-designed molds and cured.

Known apparatus for manufacturing reinforcement cages for tower segments requires a supporting structure, which holds numerous rods called rakes. These rods respectively have holding fixtures for holding steel cables, wherein the steel cables are arranged around the supporting structure in order to form ring elements. Stabilized by the rods, these ring elements are connected with steel elements that are orthogonal to them and preformed in an arched shape, through which a grate-shaped reinforcement cage is created. The reinforcement cables are either wrapped around a stationary supporting structure, or, preferably, are located in a stationary feeding device and are pulled out of the rotatory holding fixture by the supporting structure and, due to the rotational movement of the supporting structure, are arranged in rings around the supporting structure. The shape of the ring-shaped steel cables is stabilized throughout by the supporting structure and the rods by numerous spokes extending between the supporting structure and the rods. In known systems, in order to remove the reinforcement cages from the apparatus the spokes must either be detached or the stabilizing rods have to be unhooked from the steel cables individually and manually.

Depending on the size of the tower segments to be manufactured, even the reinforcement cages are of considerable weight and, depending on the tower segment, considerable size. A reinforcement cage for the lowest, i.e., the largest tower segment of a type E126 wind turbine from ENERCON, for example, has a diameter of around 14 m, a height of around 3.7 m and a weight of around 8.5 t. Due to their grate-like structure and enormous size, it is very hard to handle the reinforcement cages with conventional crane systems during production.

BRIEF SUMMARY

One or more embodiments of the present invention is to provide a gripping device of the type mentioned above, wherein the gripping device makes it possible to grip and handle reinforcement cages safely. In this context, handling specifically means gripping a reinforcement cage and moving the reinforcement cage from point A to point B.

One or more embodiments of the present invention achieves its purpose as a gripping device of the type mentioned above by specifying that said gripping device comprises a gripper arm holding fixture and numerous gripper arms, which are arranged radially on the gripper arm holding fixture; at each gripper arm a coupling mechanism, with for example one or several chains, means that it can be connected to the reinforcement cage, and the length of the gripper arms can be telescopically motor-adjusted; the gripping device can also be coupled with a lifting device that can be moved horizontally and vertically and is adapted to move a reinforcement cage from an apparatus for manufacturing reinforcement cages and/or to lower a reinforcement cage into a casing to produce a tower segment. In this context, it is noted that to safely handle reinforcement cages, it is advantageous to grip the reinforcement cage at multiple places around its circumference. To this end, the gripping device comprises multiple radial gripper arms on the gripper arm holding fixture. The radial arrangement provides that the reinforcement cage is evenly gripped around its circumference. Furthermore, the telescopic adjustability of the length of the gripper arms provides that the reinforcement cage can be controlled and gripped by all gripper arms around its circumference. Preferably, the coupling mechanism on the gripper arms is designed as gripping hooks attached to pulling elements such as chains or steel cables, which allow for quick coupling and uncoupling and, due to the suspended coupling of the coupling mechanism with the gripper arms, at the same time allows for a certain rest tolerance with regard to the circularity of the reinforcement cage. If the set arm length means a gripper arm does not end exactly at the diameter of the reinforcement cage, this is, at least to a certain extent, compensated by the pendulum-like suspension of the coupling mechanism.

In one embodiment, the gripping device has an electronic control device, which is configured to set the length of the gripper arms to a predefined value, which is a function of the diameter of a reinforcement cage to be gripped. The control device provides the advantage that by inputting the predefined value, all arms can be synchronously set to one length corresponding to the predefined value. To this end, the electronic control device is preferably designed to interact with the motor drives or, if a central drive is used, with the central drive being used to control or regulate the gripper arms.

In a preferred embodiment, the electronic control device is connected with an input device and has a data memory, wherein the data memory contains a table for storing a number of datasets is stored, wherein the datasets comprise information defining the reinforcement cage to be gripped. It is especially preferable the data memory can store several datasets defining multiple reinforcement cages that can be grabbed.

Preferably, the input device interacts with the control device in such a way that a dataset can be selected using the input device, that the selected dataset is transmitted to the control device and the length of the gripper arms is set as a function of the dataset.

In another preferred embodiment, the control device comprises one or several rotary selector switches, the different rotational positions of which are respectively programmed in advance through known programming means for a certain selectable diameter.

In another preferred embodiment, to communicate data, the electronic control device communicates with an electronic control unit in apparatus for manufacturing wind turbine tower segment reinforcement cages, and is configured to receive a dataset containing the predefined value from the electronic control unit of the apparatus.

Preferably, the dataset comprises information on: a wind turbine type and/or tower type of a wind turbine and/or a selected tower segment of the wind turbine type and/or of the tower type, and/or a reinforcement cage diameter corresponding to the selected tower segment.

Preferably, the dataset can be selected by means of the input device in a cascade-like manner: first the electronic control device gives the user the input option to select a wind turbine and/or a tower type, and, in a second step, the electronic control device gives the user the option to select one from several tower segments of the tower type or of the wind turbine. Then a specific reinforcement cage diameter, which the gripping device is to be moved to, is assigned to the tower segment within the dataset. Preferably, the dataset(s) are programmed in advance by an operator and/or are imported from the apparatus for manufacturing reinforcement cages into the electronic control device.

In an especially preferred embodiment, the input device has a touchscreen. The touchscreen simultaneously enables the display of the selection options provided by the control device and the provision of the option to input control commands.

Preferably, the input device and the electronic control device are able to communicate data wirelessly. Preferably, the input device is configured as a radio remote control. According to a preferred alternative, the electronic control device and the input device have corresponding interfaces for a wireless network connection (WLAN).

In another preferred embodiment, the electronic control device is configured to receive control commands entered manually into the input device and to adjust the length of the gripper arms as a function of these control commands. Manually control of the gripper arms makes it possible to re-adjust the gripper arm length programmed through the control device so that smaller variations in the actual dimensions of the reinforcement cages can be taken into account. Preferably, the electronic control device is equipped with a safety mechanism, which, by being in a locked position, prevents the manual input of control commands into the control device, and which, by means of unlocking the locked position, has to be brought into an unlocked position in order to enable the manual input of control commands. This locking function can be realized through the software or through hardware, for example by means of a key.

According to another preferred embodiment, the electronic control device can be switched between a first and a second operating mode: in the first operating mode, the input device interacts with the control device in such a manner that a dataset can be selected by means of the input device, the selected dataset is transmitted to the control device and the length of the gripper arms is set as a function of the dataset; in the second operating mode, the electronic control device is configured to receive control commands manually entered into the input device and to adjust the length of the gripper arms as a function of these control commands. Dividing the individual control options of the electronic control device into two different operating modes ensures that, during the automatic control of the gripper arms, no manual (incorrect) operation accidentally interferes with the program sequence, and that, in turn, during a manual control input by the operator, no automatic control process intervenes.

Preferably, in another preferred embodiment, the gripping device can identify a load situation where the gripping arms are connected with a reinforcement cage and bear at least part of its weight, wherein the electronic control device communicates with the load situation identifier and is configured to prevent the adjustment of the length of the gripper arms for as long as the gripper arms are connected with a reinforcement cage and bear at least part of its weight. In view of the sometimes considerable weight of the reinforcement cages to be handed, in practice it has to be assumed that the length of the gripper arms and thus the reinforcement cage diameter controlled by the gripper arms changes due to the load. The load situation identifier, which can, for example, be designed as load sensors, strain gauges or similar measuring equipment, is preferably integrated into a control circuit or loop of the electronic control device.

Alternatively or in addition, the gripping device can identify the gripper arm length, preferably the load-dependent change of length of the gripper arms, which are independent from the drive of the gripper arms. Thus, sinking movements and adjustments of the length are identified due to tolerances and transmitted to the control device, which, in turn, can re-adjust the gripper arm lengths as a function of these identified changes.

In addition, preferably, the electronic control device of the gripping device and/or the input device of the gripping device comprises an emergency stop switch, and the electronic control device is configured to stop the adjustment of the gripper arms immediately as soon as the emergency stop switch is used. This makes it possible to stop the movement of the gripping device due to suddenly occurring events; this can be particularly relevant if the wrong program, which threatens to damage the reinforcement cage, was selected by accident.

According to another preferred embodiment of the invention, the gripper arms of the gripping device respectively comprise several joints, which can be moved translationally in relation to each other by means of a chain drive. To this end, the chain drive is coupled with a central electromotive drive. The individual joints of the gripper arms can be coupled with each other through drivers in a force-fit and/or form-fit manner. In order to enable free adjustment of the gripper arm length and joint positions, the position of the drivers can be adjusted at the joint respectively assigned to them. As examples of chain drives, e.g., roller chain drives or omega chain drives can be considered.

According to another preferred embodiment, each gripper arm of the gripping device has several joints, which, by means of a rack and pinion pair or by means of a moving spindle drive can be moved translationally in relation to each other. Preferably, the moving spindle drive comprises two or more overlapping threaded bars, which, through the revolving guidings are supported against occurring critical compressive forces, wherein the threaded bars have different inclinations and thread directions. Preferably, the threaded rods are driven by a central motor.

According to a second aspect, the invention relates to a handling system for reinforcement cages for tower segments of a wind turbine. The system comprises a gripping device according to one of the above embodiments, a lifting device that can be moved horizontally and vertically, with which the gripping device is coupled, as well as apparatus for manufacturing reinforcement cages for tower segments of wind turbines.

Preferably, the apparatus for manufacturing reinforcement cages for tower segments of wind turbines comprises a supporting structure, which can be driven by a rotor around an axis X, multiple rods that are arranged in parallel or conically to each other in relation to the axis X and are distributed, preferably evenly, around the supporting structure around a circumference, wherein each of the rods is connected with the supporting structure by means of two or more spokes and on the exterior side facing away from the supporting structure has multiple recesses, which are installed for receiving reinforcement material, wherein respectively, a number of spokes corresponding to the number of rods is arranged in one plane perpendicular to the axis X, and wherein the length of the spokes can be telescopically adjusted by motor.

The invention according to the second aspect is further advantageously developed by allowing the length of all respective spokes on a plane to be synchronously adjusted. Thus two advantages are achieved. On the one hand, the synchronous adjustment of all respective spokes on a plane ensures that the spokes on this plane provide a circumference with their outer ends. On the other hand, this means that not all spokes on the supporting structure are set to exactly the same length, but instead that the spokes on each plane are the same length, while the spokes on a neighboring plane may be a different length, which, in turn, can be adjusted synchronously for all spokes on the respective plane. Thus, even conical reinforcement cages can be created, which, in particular with regard to the towers of wind turbines, is especially preferable.

Preferably, the length of the spokes can be adjusted in smoothly. In this context, an adjustment of spoke length in steps of a few millimeters, for example three to four millimeters per step, is also considered to be smooth, which, in the light of the large diameters of tower segment reinforcement cages is obvious without any further explanations.

According to a preferred embodiment of the invention pursuant to the second aspect, the device has a central drive unit or a central drive unit for each plane of spokes, which is respectively installed for adjusting the spokes by motor and to which a transmission is coupled for each spoke, which can be synchronously driven by the drive unit. According to the first alternative of these preferred embodiments, a single drive unit is used to provide the synchronous drive of all spokes in the device by means of corresponding power transmission units. Each drive motion of the central drive unit changes the length of the spokes by the same amount. This mechanically forced synchronization can be used to manufacture cylindrical reinforcement cages as well as conically tapering reinforcement cages, by setting the spokes of their respective plane to a basic length relevant to the respective plane. The different basic lengths define the angle of the taper, since they define a different diameter for each plane. If all the spokes on one plane are changed by a central drive unit by the same deflection amount, this will result in a change in diameter, since all the planes have changed consistently, but not in a change of the taper angle.

According to the second alternative of this preferred embodiment, each plane of spokes can be separately motor-driven by its own drive unit. Thus, the spokes of the respective plane can be adjusted synchronously to each other but independently from the other planes. This allows reinforcement cages with different taper angles to be manufactured.

The preferred embodiment is further developed by using a drive unit with a shaft with one or several gear wheels and spoke transmission respectively coupled with the shaft by roller chains. According to a preferred alternative, the drive unit is a hydraulic drive, and each spoke has a hydraulically operated piston for adjusting the length, which is put under pressure by the hydraulic drive.

According to another preferred further development of the invention pursuant to the second aspect, the apparatus has a decentralized drive system for motor-driven length adjustment, namely in such a way that each spoke has a drive unit of its own. Preferably, the respective drive is synchronously controlled by one electronic control unit for all spokes on a plane or for all spokes. The higher equipment costs caused by the larger number of individual drives are compensated by the fact that no central drive system controlling all the spokes and no central transmission system are required. Command transmission to the respective drive units can be controlled by electronic control commands synchronously and with little effort, since it is possible through simple, technically known methods to transmit the same control command at the same time to all drive units.

According to this embodiment, each spoke preferably has a telescopic spindle drive, a magnetic linear drive or a rack and pinion drive. All of these drive systems can be driven in an advantageous manner by means of electronically controllable servomotors.

According to another preferred embodiment, the electronic control unit is configured to control the central drive unit or the drive units for each plane of spokes or each of the decentralized drive units in such a way that each plane of spokes defines a predefined diameter at the outer ends of the spokes.

According to another preferred further development, by being mechanically decoupled from all but up to one spoke, the rods can be folded from their parallel arrangement in relation to the supporting structure or from being arranged conically to each other into another angled arrangement in relation to their original arrangement.

It is further preferred that the rods are attached to the spokes by means of one coupling joint each, wherein the coupling joints are installed for swiveling the bars in the direction of the axis X and simultaneously for reducing the circumference around which the rods are arranged. According to another preferred embodiment, per plane of spokes, two or more, preferably all, coupling joints can be motor-driven for performing the swiveling movement.

According to another preferred embodiment, per rod, at least one of these coupling joints can be blocked by a blocking element, wherein the blocking element can be moved into a locked position or an unlocked position at the operator's choice, preferably by means of swiveling.

It is especially preferred that the blocking element is configured to extend in an arched shape around the coupling link in the locked position and to close a gap between the spokes and the rod, wherein the shape of the blocking element has a design corresponding to the shape of the gap.

BRIEF DESCRIPTION OF THE SEVERAL VIEWS OF THE DRAWINGS

The invention is described in more detail below by means of preferred exemplary embodiments, with reference to the attached figures. The figures show the following.

DETAILED DESCRIPTION

Figure 1:
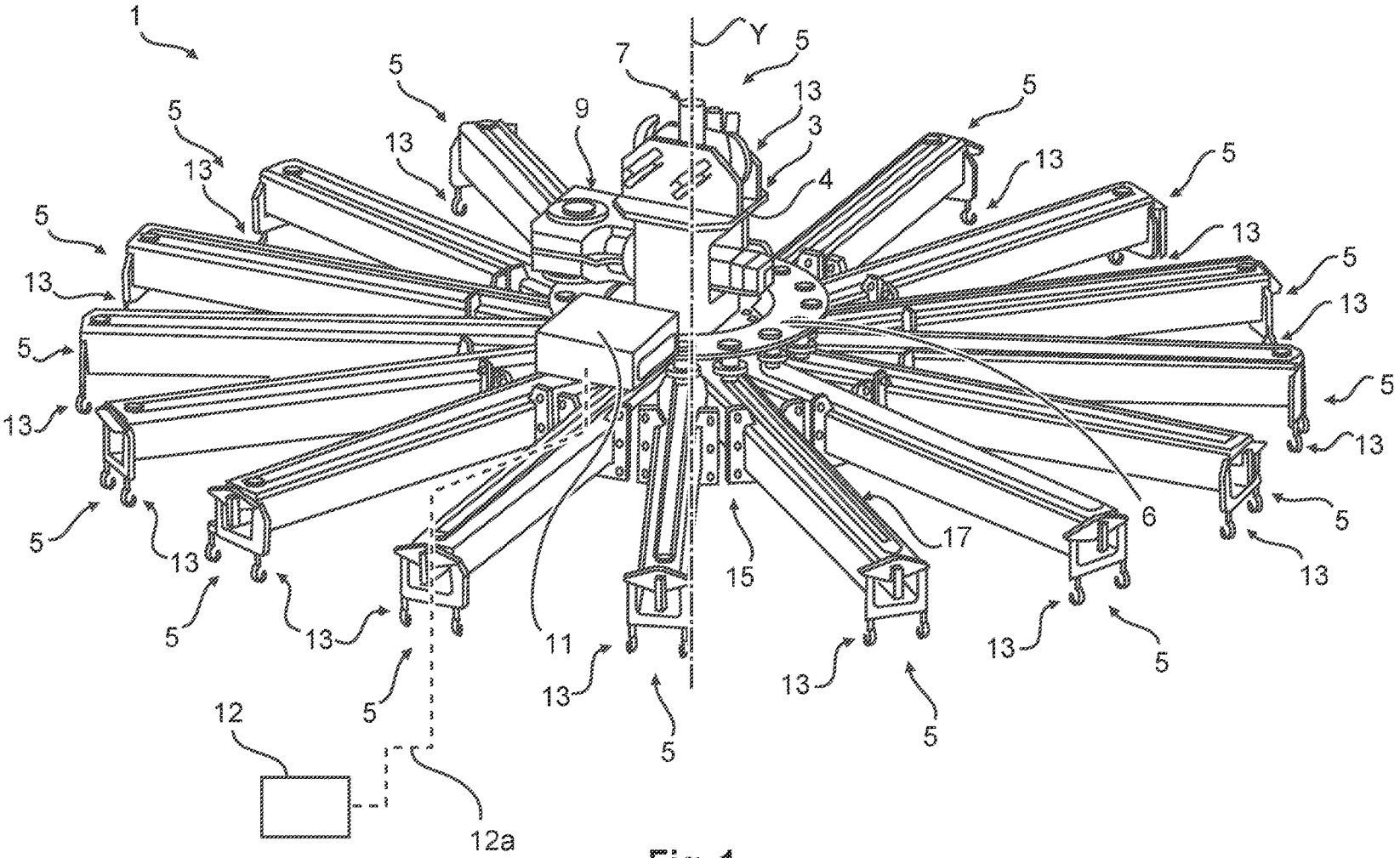
FIG. 1 shows the schematic view of a spatial illustration of the gripping device according to a preferred exemplary embodiment in a first operating position.

The fundamental design of a gripping device 1 for handling reinforcement cages for tower segments of a wind turbine is illustrated in FIG. 1. The gripping device 1 has a gripper arm holding fixture 3. The gripper arm holding fixture 3 has a frame 4, to which multiple gripper arms 5 are radially attached. Essentially, the gripper arms 5 are distributed evenly around the circumference of a ring 6. Essentially, the gripper arms 5 are arranged perpendicularly to a central axis Y. The axis Y is preferably located in the intersection of the extension of the longitudinal axis of the gripper arms 5. A lifting device 7 is coupled with the gripper arm holding fixture at the upper part (in the arrangement according to FIG. 1) of the frame 4. Preferably, coupling is performed in accordance with DIN 15401 and/or 15402.

An electromotive drive 9 is attached to the frame 4 of the gripper arm holding fixture 3. The electromotive drive 9 provides torque for the motor-driven adjustment of the length of the gripper arms 5. Preferably, the gripper arms 5 are coupled with the electromotive drive through chain drives 17 (for the sake of clarity only one is marked with a reference number) through one or several transmission units. Optionally, the gripper arms 5 can be uncoupled from the drive train.

The gripping device 1 has an electronic control device 11, which, in this exemplary embodiment, is also attached to the gripper arm holding fixture 3. The electronic control device 11 is configured to set the length of the gripper arms to a predefined value, which is a function of the diameter 1 of the reinforcement cage to be gripped. Preferably, the electronic control device can be controlled through an input device 12. As indicated in FIG. 1 by the dotted line 12*a*, the input device 12 is connected to the electronic control device for the purpose of data communication. The connection can be wired or wireless.

At each end furthest away from the axis Y, the gripper arms 5 each have coupling mechanisms 13, which, in this exemplary embodiment, are designed as hooks hanging on chains. The coupling mechanisms are configured to be connected with a reinforcement cage, once a predefined diameter has been reached. Once the reinforcement cage has been connected with the coupling mechanism 13, by moving the lifting device 7, the gripping device 1 can bear the weight of the reinforcement cage.

Each gripper arm 5 has torque supports 15, which absorb the weight borne by the gripper arms and transfer it to the gripper arm holding fixtures 3. Furthermore, these supports make it possible to design the gripper arms to be separable, so that the arms can be removed separately and can be reconnected. Thus, the transport size of the apparatus is reduced.

Figure 2:
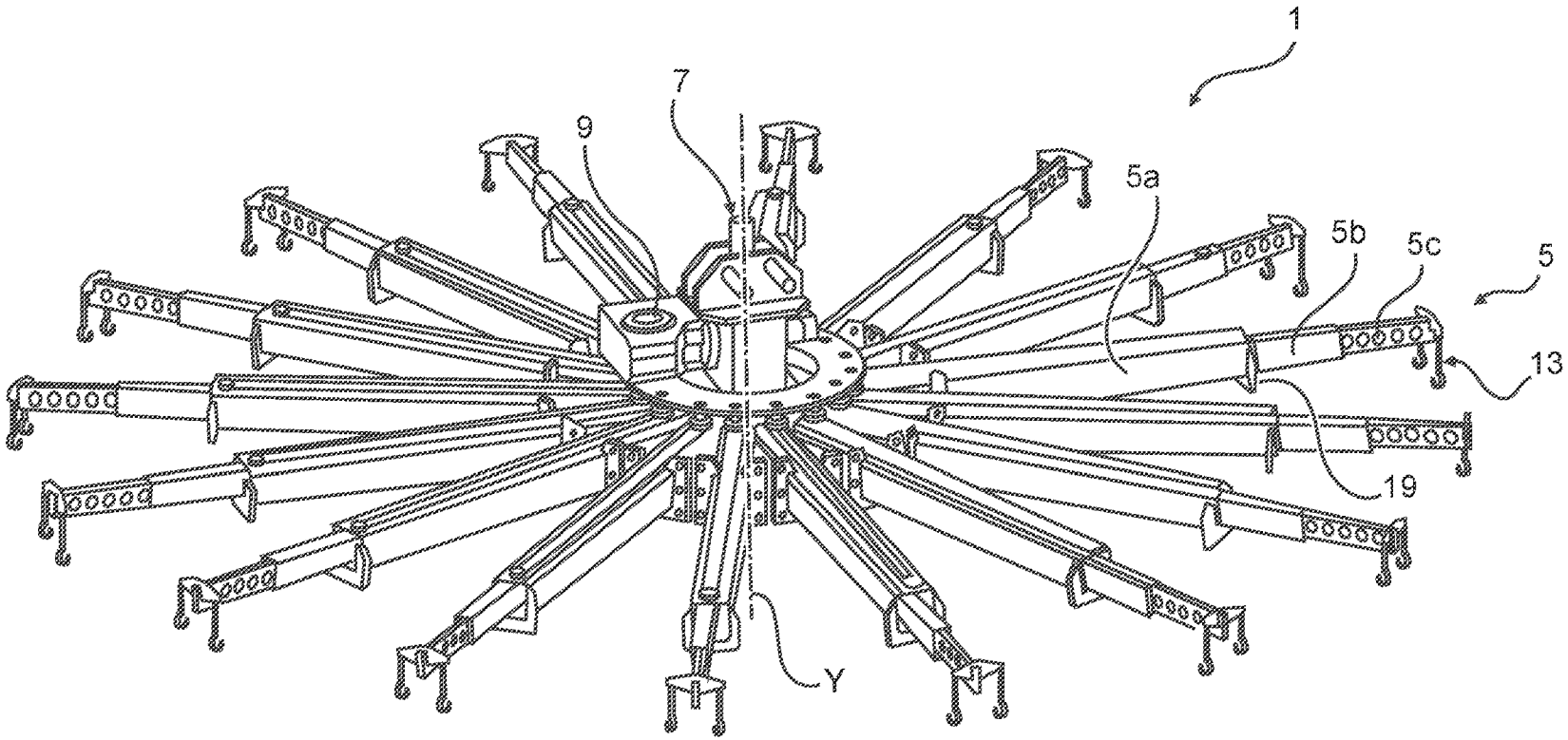
FIG. 2 shows the gripping device according to FIG. 1 in a second operating position.
Figure 3:
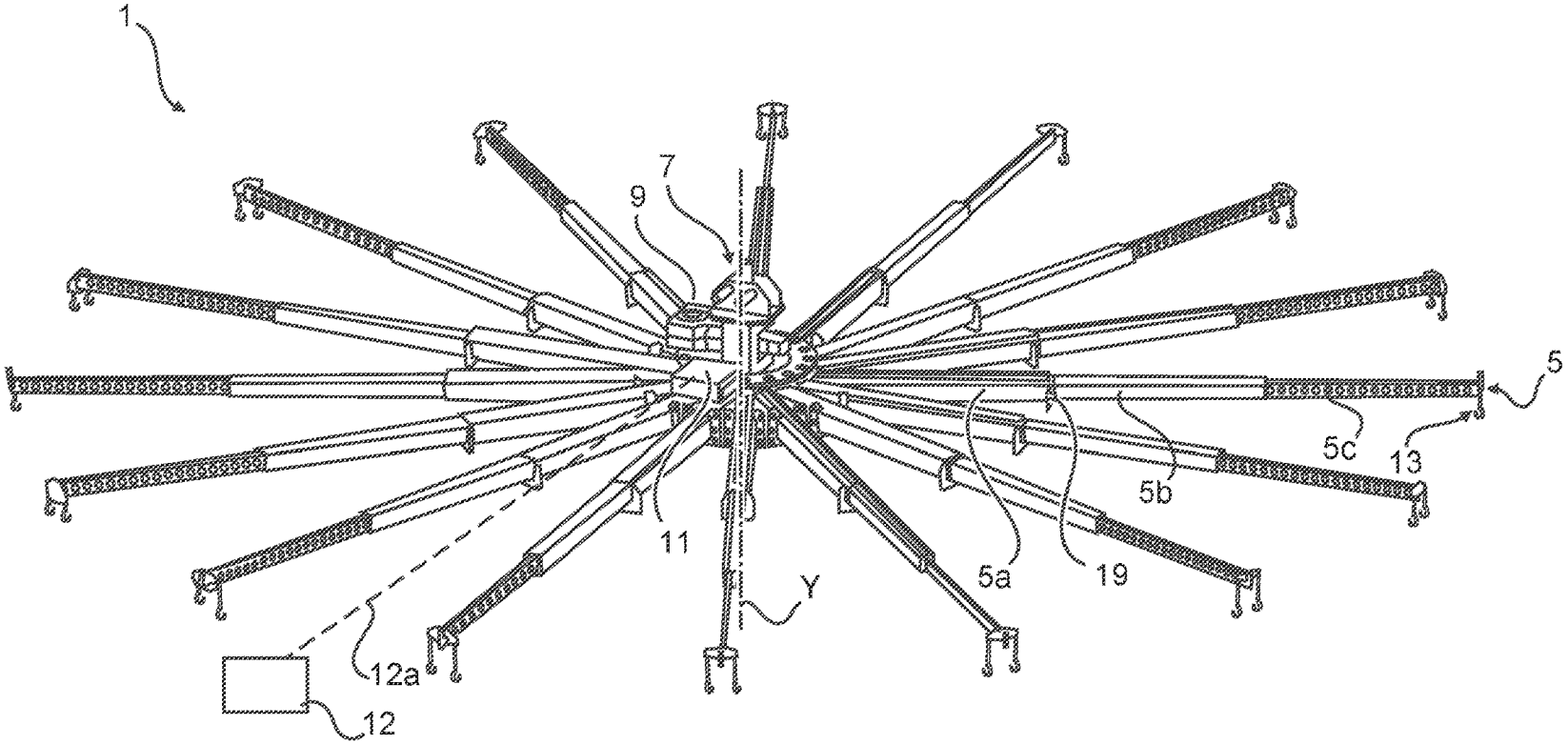
FIG. 3 shows the gripping device according to FIGS. 1 and 2 in a third operating position.

As can be seen further in FIGS. 2 and 3, the gripper arms 5 each have a second support element 19 performing the same function as the support 15. The supports 19 each have a bearing roller, preferably on their inside. In addition, the apparatus can be put down on the mounting links of the supports 19, which, in the shown arrangement, point "down".

As can be inferred in particular from FIGS. 2 and 3 in comparison with FIG. 1, gripper arm 5 length can be adjusted by the telescopic arrangement of several joints 5*a*, 5*b*, 5*c*. FIG. 2 shows a state in which the gripper arms 5 are set to a length between a minimum length (FIG. 1) and a maximum length (FIG. 3) through the joints 5*b*, 5*c* being partially pulled out from the joint 5*a* closest to the inside. Accordingly, FIG. 3 shows the operating position of the gripping device 1 with a maximum extension of the gripper arms 5.

In a preferred exemplary embodiment, the gripping device according to FIGS. 1 to 3 interacts with apparatus 101 for manufacturing reinforcement cages for tower segments of wind turbines. The apparatus 101 is shown in FIGS. 4 to 13.

Figure 4:
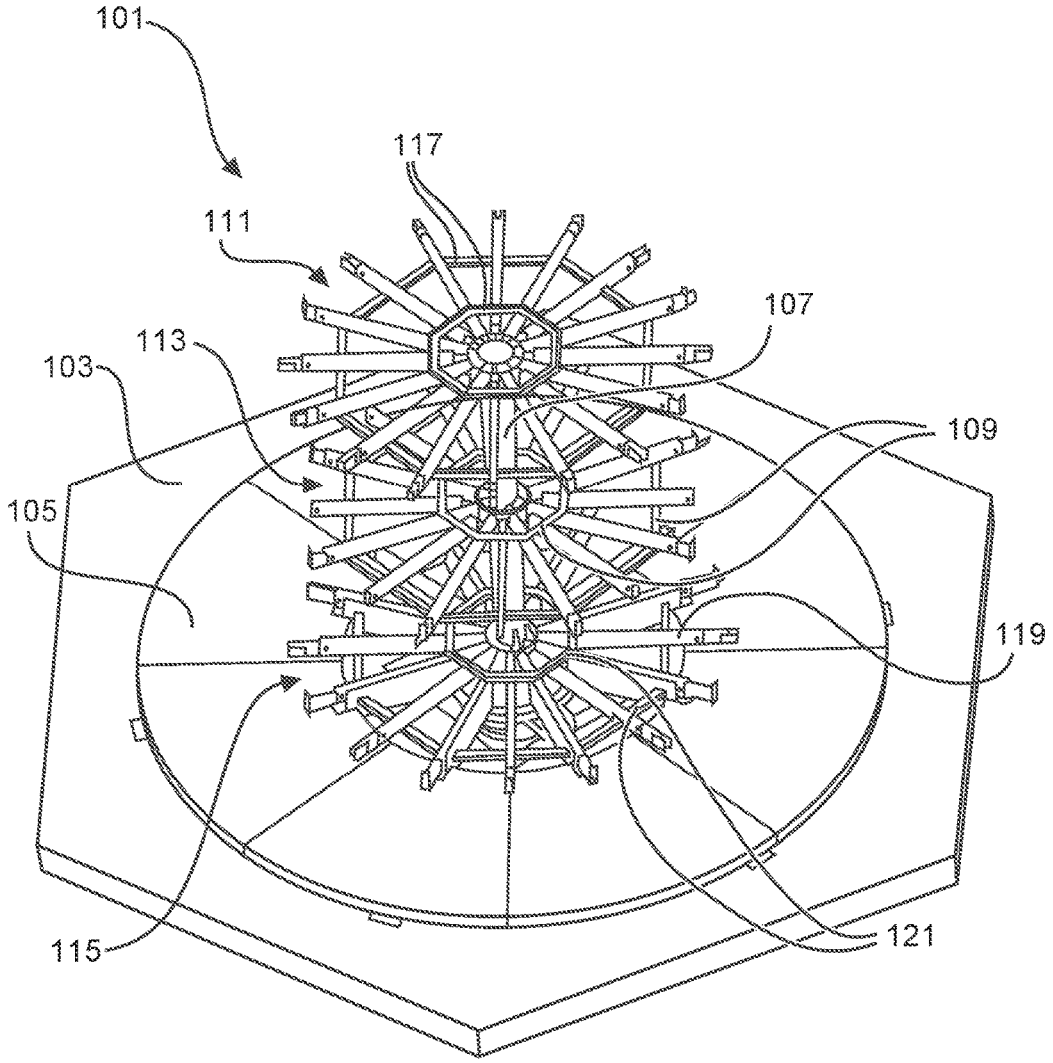
FIG. 4 shows a spatial illustration of apparatus for manufacturing reinforcement cages as part of a system according to a preferred exemplary embodiment of the invention.

FIG. 4 shows the fundamental design of apparatus for manufacturing reinforcement cages for tower segments. The apparatus 101 has a stationary base plate 103 (for example, made of concrete) relative to which there is a platform 105 that can be driven by a rotor. Preferably, the platform 105, which can be driven by a rotor, is located on top of the stationary base plate 103. A supporting structure 107 extends perpendicularly from the platform 105. On a total of three planes 111, 113, 115, multiple spokes 119 are arranged on the supporting structure 107. In alternative designs, only two planes are intended for tower segments for shorter constructions.

The spokes 119 extend outwards from the supporting structure. In the illustrated exemplary embodiment, the spokes 119, of which, for the sake of clarity only one is marked with a reference number, are arranged radially. However, other arrangements are possible as well, as long as an adjustment in spoke length changes the circumference of the imaginary limitations surrounding the spokes. The spokes on the highest plane 111 are connected with each other by means of cross-beams 117 for strengthening. The spokes of the second plane 113, which is arranged at a distance from the first plane 111, are connected with each other by means of cross-beams 119 for strengthening, and the spokes of the third plane 115, which is arranged at a distance from the second plane 113, are connected with each other by means of cross-beams 121 for strengthening. In alternative designs, the means for strengthening can be omitted for tower segments for shorter constructions.

FIG. 5 illustrates once again the arrangement of the different planes 111, 113, 115 on top of each other in the apparatus 101. In this context, the term plane does not mean the horizontal arrangement of the spokes in a strictly geometrical sense, but the arrangement of similar, different platforms in buildings or on scaffolding. However, in the exemplary embodiments shown in FIGS. 4 and 5, the beams are indeed arranged essentially perpendicularly to the rotation axis X of the supporting structure 107.

Figure 5:
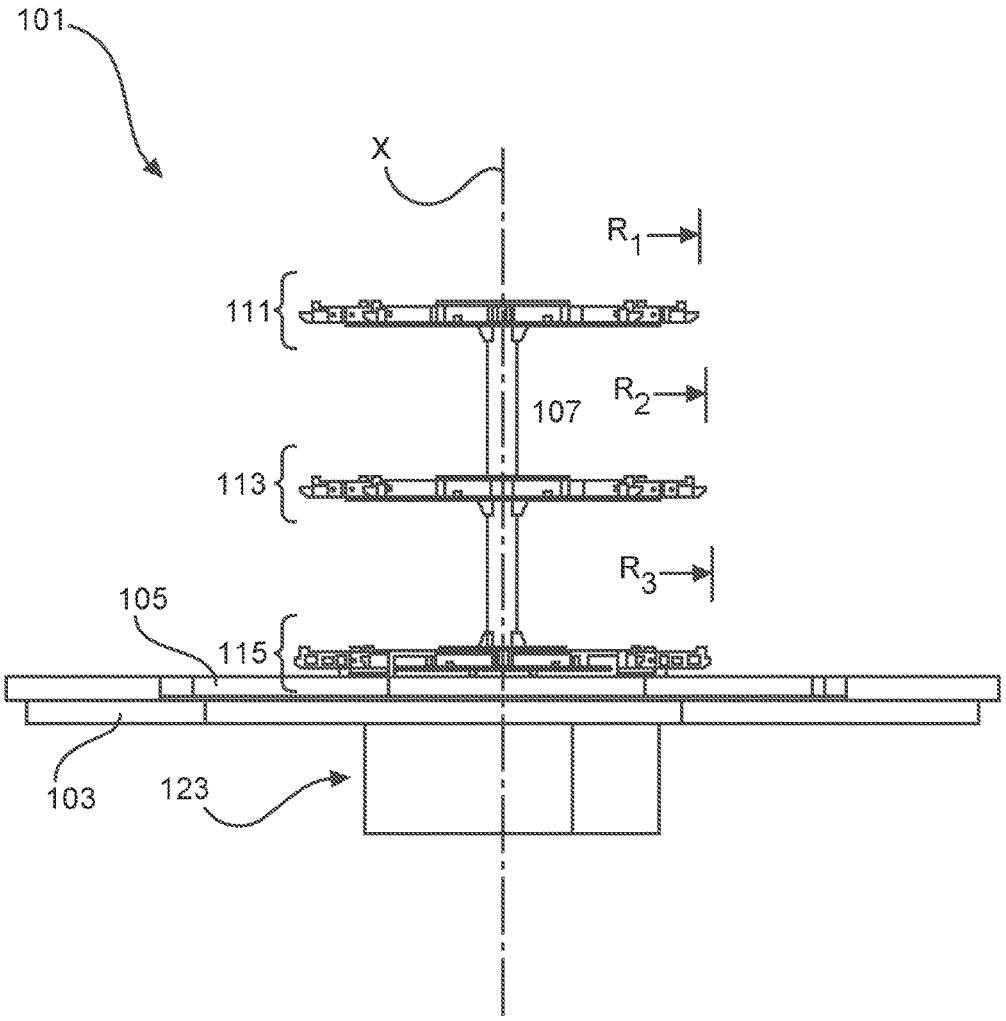
FIG. 5 shows a side view of the apparatus according to FIG. 4.

The radially exterior furthest points of the spokes on the first plane 111 define a radius R1. Likewise, the spokes of the second plane 113 define a radius R2, and the spokes of the third plane 115 likewise define a radius R3. Furthermore, FIG. 5 shows that housing 123 is provided below the stationary platform 103. Preferably, the drive units for the supporting structure 107 as well as a central drive unit or an electronic control unit for controlling several decentralized drive units (not shown) are located within the housing 123.

Figure 6:
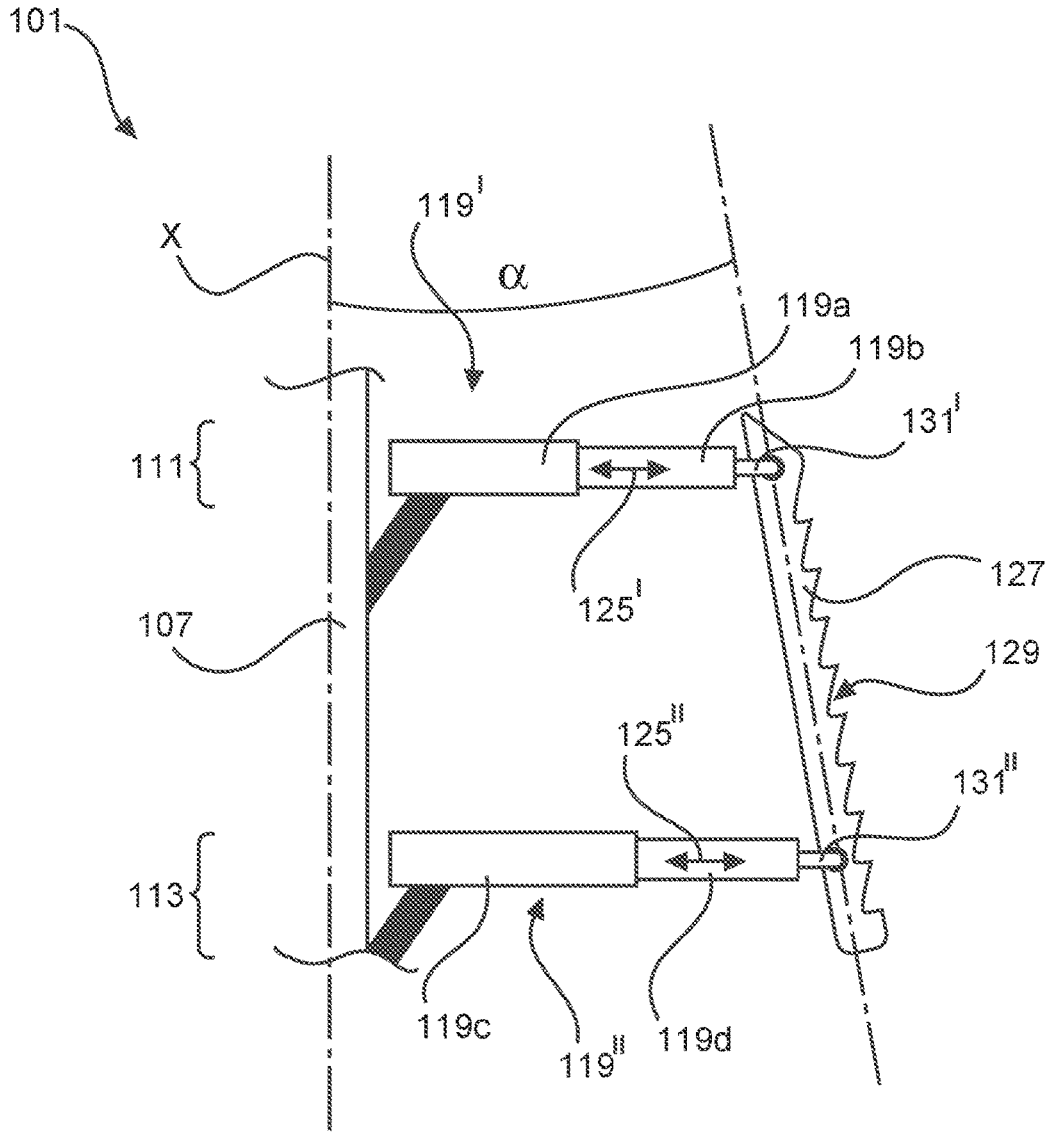
FIG. 6 shows a schematic diagram of a detail of FIG. 5.

FIG. 6 shows a schematic view of a section of the apparatus according to FIG. 5. The illustration shows just one spoke 119' located on the first plane 111, as well as one spoke 119" on the second plane 113.

While in order to provide a clear illustration of the supporting structure and the spoke arrangement, the rods for receiving the reinforcement cables were not shown yet, and FIG. 6 shows by way of example one rod 127 in the mounted position. In the illustrated position, the rod 127 is arranged at an angle α to the vertical axis X. Applied to all the rods on the apparatus, this means that the bars are arranged conically to each other. The angle α can be specified through the varying length of a base body 119*a* of the spoke 119' and a deviating length of the base body 119*c* of the spoke 119". When the telescopic elements 119*b*, 119*d* of the spokes 119', 119" are fully extended, the angle results from the distance between the spokes 119' and 119" in the direction of the axis X as well as from the different lengths of the bodies 119*a*, 119*c*. Alternatively, the angle can be adjusted by extending the telescopic element 119*b* of the spoke 119' by a different amount in the direction of the arrow 125' as the extension of the telescopic element 119*d* of the spoke 119" in the direction of the arrow 125".

As can be further seen in FIG. 6, the rod 127 has multiple holding fixtures 129 for guiding the reinforcement material. Preferably, the reinforcement material is reeled strip steel, for example steel strip 500 (in accordance with DIN 488). On the respective planes 111, 113, the rod 127 can be swiveled to connect with the corresponding telescopic elements 119*b*, 119*d* of the spokes 119", 119" by means of a coupling joint 131', 131". If the apparatus is configured in such way that the lengths of the spokes 119', 119" in the direction of the arrows 125', 125" are adjusted differently from each other, slot guides for receiving the coupling joints 131', 131" will preferably be provided in the rod 127 in order to accommodate the resulting change to the angle α.

Figure 7:
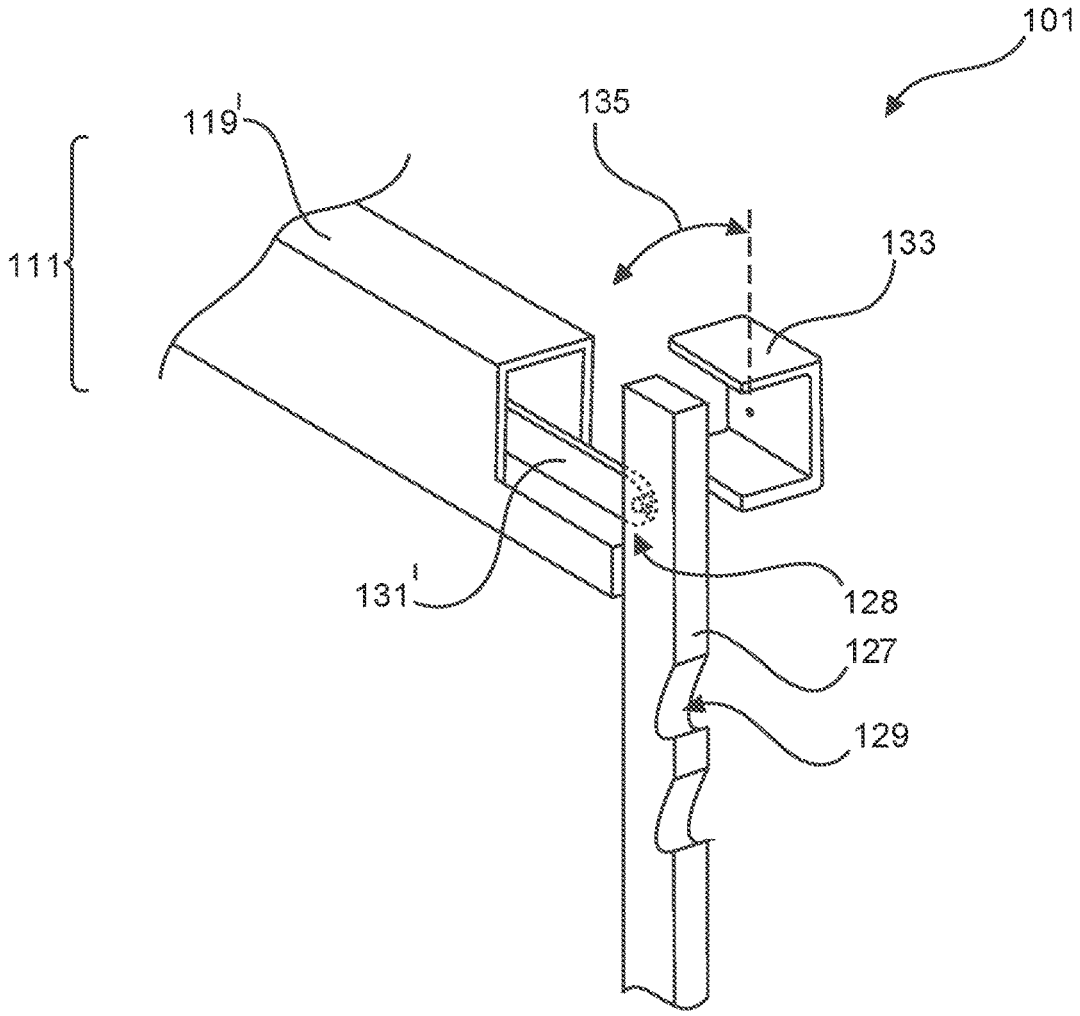
FIG. 7 shows a spatial illustration of a detail of the apparatus according to a further exemplary embodiment.

Based on an exemplary spoke 119' on the plane 111, FIG. 7 shows another aspect of the apparatus 101. At one end of the spoke 119' that is radially furthest to the outside, the coupling joint 131' extends outside the spoke 119'. In a section 128, the coupling joint 131 can be swiveled to connect with the rod 127. Between the spoke 119' and the rod 127, there is a gap. Essentially, the width of the gap corresponds to the width (in radial direction) of a blocking element 133. In FIG. 7, the blocking element 133 is shown in the unlocked position. In order to prevent a swiveling motion of the coupling joint 131' and, thus, to fix the distance between the rod and the supporting structure (which is not shown), the blocking element 133 can be moved from the illustrated unlocked position into a locked position. According to the preferred exemplary embodiment, this is performed with a swiveling motion in the direction of the arrow 135. By means of the swiveling motion, the blocking element is brought in a position where it rests against the spoke 119' and the rod 127. An interlocking option is provided optionally. Optionally, the swiveling motion is performed by a servomotor or a mechanical moving device such as a pulley. In the locked position, the radial distance between the holding fixture 129 is fixed in relation to the rotation axis X of the supporting structure 107 (cf. FIG. 5) and is kept constant during the operation of the apparatus 101, which ensures the even formation of the reinforcement cage.

Alternatively to the swiveling holding fixture described above, the bars can also be coupled directly with the arms, for example by hooking. In this case, the diameter of the reinforcement cages would be enabled within certain limits by means of bolt connections positioned accordingly.

Figure 8:
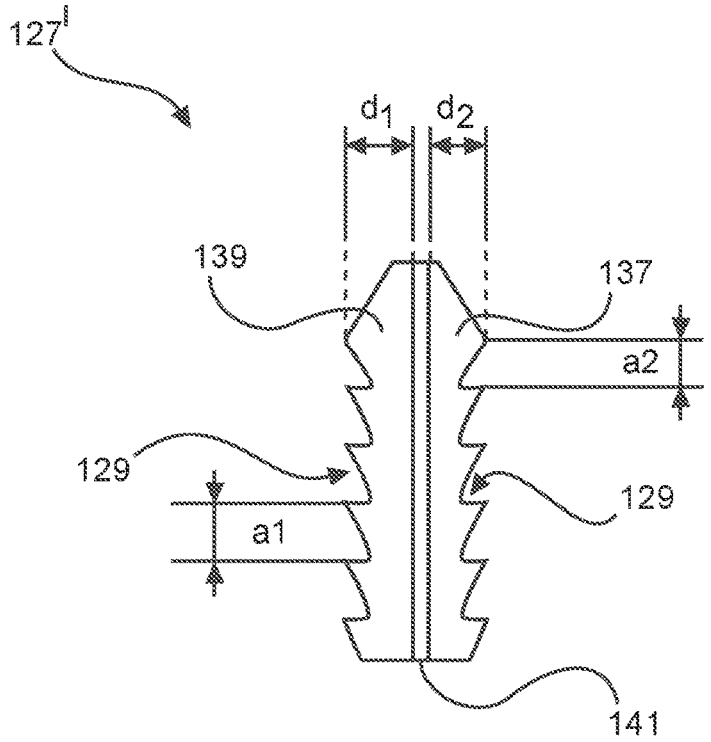
FIGS. 8 and 9 show a side view and a cross-section of a part of the apparatus according to another exemplary embodiment.
Figure 9:
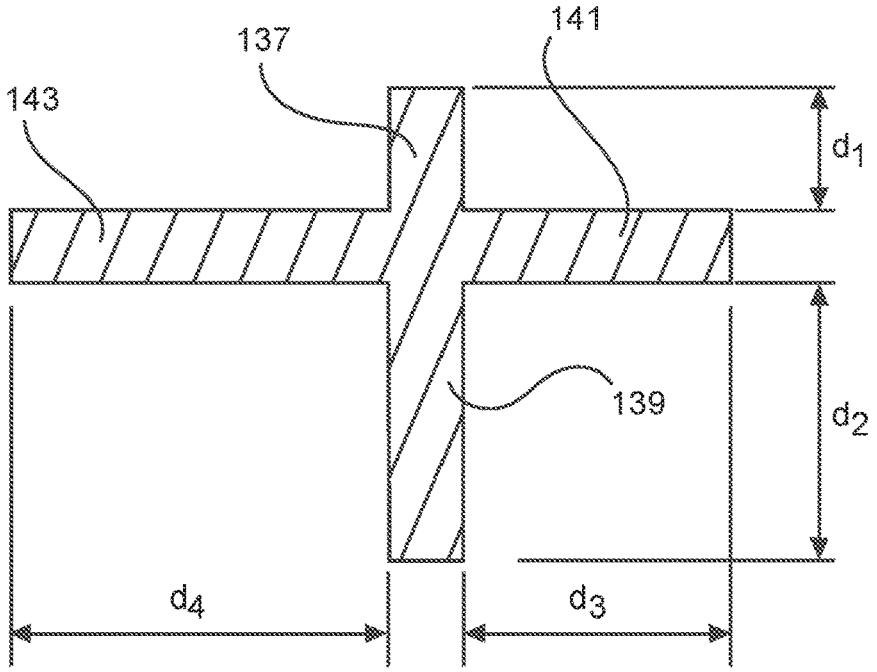

FIGS. 8 and 9 show one version 127' of the rod with the holding fixtures 129. As its base, the rod 127' has an oblong square body, from each of the four oblong sides of which extends an edge with multiple recesses 129, wherein a first edge 137 has the edge height d1. Unlike this edge height d1, second edge 39 has an edge height d2, which differs from the edge height d1. A third edge 141 has the edge height d3, while a fourth edge 143 has the edge height d4. The edge heights d1, d2, d3, d4 respectively differ from each other. The rod 127' can be coupled with the spokes of the apparatus in such a way that one of the four edges 137, 139, 141, 143 faces away from the rotation axis X of the supporting structure 107 so that only this edge is brought into a position where it holds the reinforcement cables. Due to the different edge heights, different outer diameters or circumferences for the reinforcement cables to be received can also be defined by means of the bars 127' that can be positioned in the four different angle positions. Furthermore, the respective edges 137, 139, 141, 143 preferably have distances between the recesses 129 differing from those of the other edges. In FIG. 8, this is suggested by way of example for the edges 137 and 139 through the different distances $a_1$ (for edge 139) and $a_2$ (for edge 137).

Figure 10:
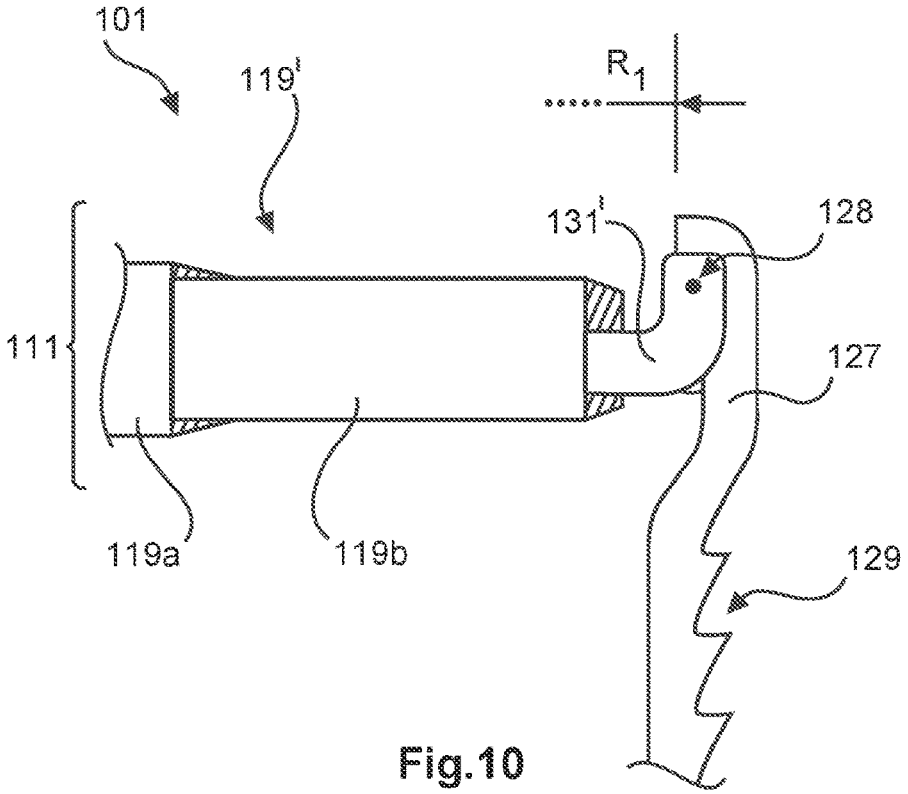
FIGS. 10 and 11 show a detailed view of the apparatus according to another exemplary embodiment in different operating states.
Figure 11:
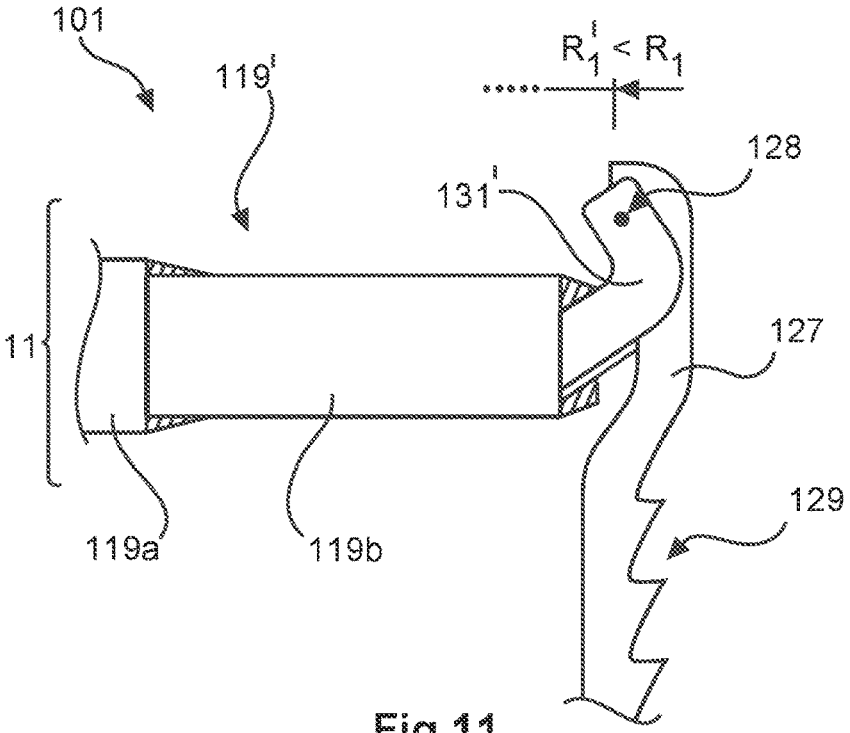

FIG. 10 shows another detail according to a preferred exemplary embodiment of the invention regarding an exemplary spoke 119'. The telescopic element 119*b* is extended by a certain length from the base body 119*a* of the spoke 119'. The coupling joint 131' extends out of the telescopic element 119*b* and is coupled with the rod 127 in the point 128. The holding fixture 128 defines a radial distance R1 from the axis X (not shown). In the state shown in FIG. 10, the apparatus 101 is in a position where it can receive the reinforcement cables has done so. This state, in which the stabilization of the reinforcement cables has to be ensured, is R1 constant. Once the reinforcement cage has been manufactured, i.e., once the circular reinforcement cables have been connected with the additional strengthening elements, the apparatus 101 is brought into a state according to FIG. 11. In the state according to FIG. 11, the coupling joint 131' has been swiveled upwards. The other, not illustrated, couple joints in the other planes of the apparatus perform the same motions. Thus, the rod 127 is moved upwards (in relation to the arrangement in FIG. 11 in the direction of the axis X, FIG. 5) and at the same time moved inwards in the direction towards the axis X. The radial distance that the holding fixture 128 now has to the axis X is R1', which is smaller than R1. Through the swiveling motion of the coupling joints, the reinforcement cables are lifted out from the holding fixtures 129, and the manufactured reinforcement cage can be taken out of the apparatus 101 from the top. The reason why the design of the spokes with swiveling coupling joints is especially advantageous is that the reinforcement cages can be quickly detached from the apparatus 101 without the need to change the length of the adjusted spokes through control commands. The coupling mechanism can be swiveled by separate, purely mechanical actuation from the position according to FIG. 10 into the position according to FIG. 11, while the length of the spokes remains unchanged.

Figure 12:
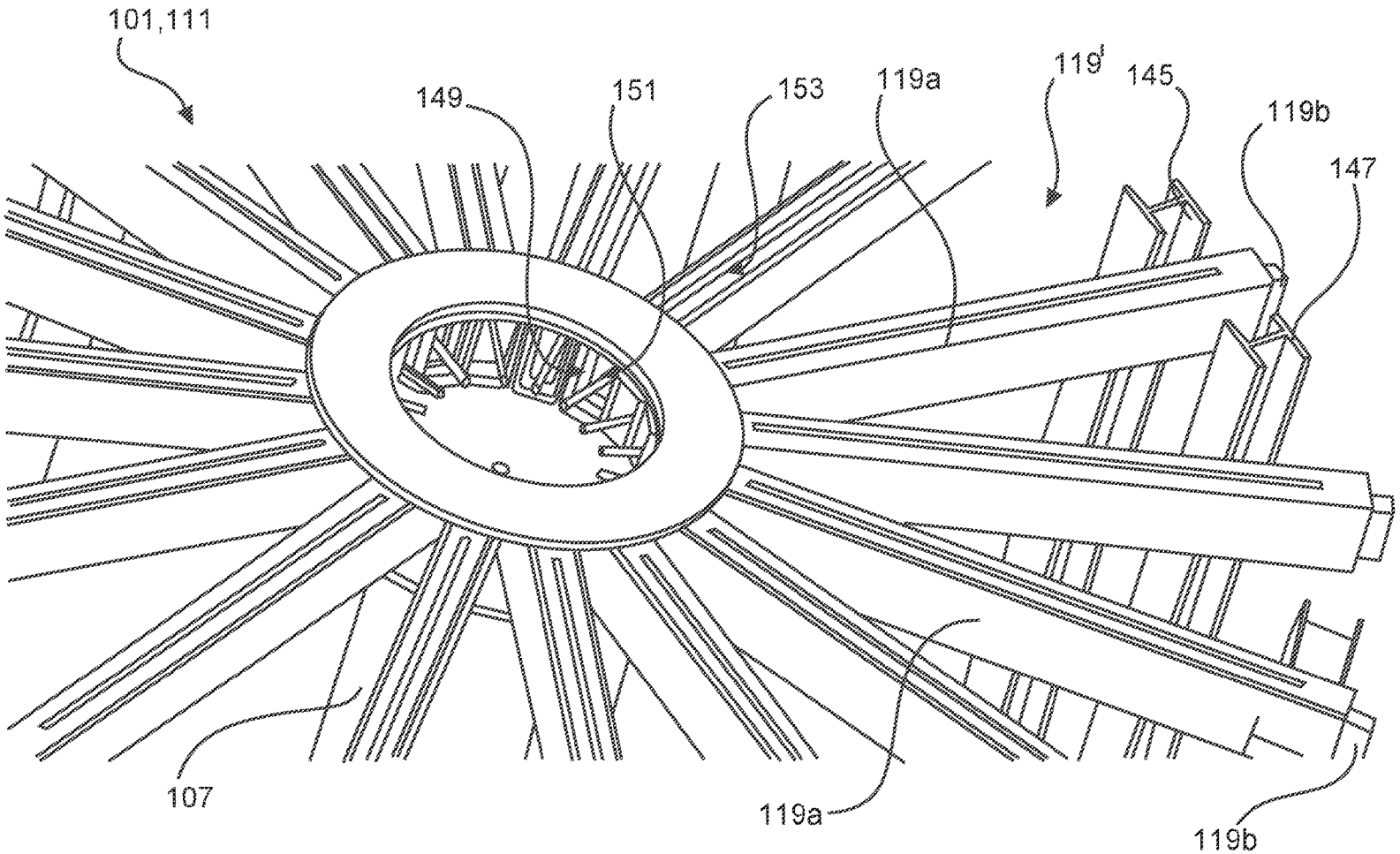
FIG. 12 shows a spatial detailed illustration of the apparatus according to another exemplary embodiment.

Ultimately, according to another exemplary embodiment of the invention, FIG. 12 presents one of the different drive concepts. The Figure shows a slanted top view of the upper plane 111 of the apparatus 101. The telescopic elements 119*b* of the spokes 119' can be moved translationally within the base body 119*a*. To perform this translational movement, there is a decentralized drive unit 149 in each spoke. In the example according to FIG. 12, the decentralized drive unit 149 is designed as a telescopic spindle drive, through the activation of which a slide 153 performs a translational movement guided by a longitudinal groove. The telescopic element 119*b* is coupled with the slide 153 and, driven by a motor, is extended or pulled in as a consequence of activating the telescopic drive 151. For the lateral support and the absorption of bearing loads, supporting struts 145, 147 are arranged on the left and on the right side of several spokes. As a general principle, in the preferred embodiments, this drive design is used for the arms of the reinforcement cage as well as for the arms of the gripping device 1. The same applies to the alternative drive designs described above.

The invention claimed is:

1. A handling system comprising:

a gripping device for handling a reinforcement cage for tower segments of a wind turbine, the gripping device including:

a gripper arm holding fixture;

at least five gripper arms arranged radially on the gripper arm holding fixture, wherein the at least five gripper arms are configured to telescopically adjust in length;

coupling mechanisms arranged on the at least five gripper arms, respectively, the coupling mechanisms being configured to be coupled to the reinforcement cage; and a motor configured to cause the at least five gripper arms to telescopically adjust in length, wherein the gripping device, when in operation, couples to a lifting device that moves horizontally and vertically, the gripping device, when in operation, at least one of:

moves the reinforcement cage from an apparatus for manufacturing reinforcement cages, or places the reinforcement cage in a casing for creating a tower segment;

a lifting device configured to be moved horizontally and vertically, the lifting device coupled to the gripping device; and an apparatus for manufacturing the reinforcement cage, the apparatus including a plurality of spokes configured to telescopically adjust in length, ends of the plurality of spokes being coupled to rods, the rods including holding fixtures configured to guide reinforcement material that is used to make the reinforcement cage;

wherein the gripping device, when in operation, moves the reinforcement cage, after being manufactured by the apparatus, from the apparatus and places the reinforcement cage in a casing for creating a tower segment.

2. The handling system according to claim 1 wherein the gripping device further comprising an electronic control device configured to cause the motor to telescopically adjust the length of the at least five gripper arms to a predefined value, wherein the predefined value is a function of the diameter of the reinforcement cage.

3. The handling system according to claim 2, wherein the electronic control device is coupled to an input device and has a data memory, the data memory containing a table in which a number of datasets is stored, and the datasets comprise information defining the reinforcement cage.

4. The handling system according to claim 3, wherein the input device interacts with the control device in such a way that:

the dataset can be selected by the input device, the selected dataset is transmitted to the control device, and the length of the at least five gripper arms is set as a function of the dataset.

5. The handling system according to claim 2, wherein to communicate data, the electronic control device communicates with an electronic control unit in the apparatus for manufacturing reinforcement cages and is configured to receive a dataset from the electronic control unit of the apparatus containing the predefined value from the electronic control unit of the apparatus.

6. The handling system according to claim 3, wherein the dataset comprises information on at least one of the following:

a wind turbine type;

a tower type of a wind turbine;

a selected tower segment of the wind turbine type;

a selected tower segment of the tower type; and a reinforcement cage diameter corresponding to the selected tower segment.

7. The handling system according to claim 4, wherein the input device has a touchscreen.

8. The handling system according to claim 4, wherein the input device and the electronic control device are configured to communicate data wirelessly.

9. The handling system according to claim 3, wherein the electronic control device is configured to receive control commands manually entered into the input device and to adjust the length of the at least five gripper arms as a function of these control commands.

10. The handling system according to claim 9, wherein the electronic control device is configured to be switched between a first and a second operating mode, wherein:

in the first operating mode, the input device interacts with the control device in such a way that a dataset can be selected using the input device, wherein the selected dataset is transmitted to the control device, and the length of the at least five gripper arms is set as a function of the dataset, and in the second operating mode, the electronic control device is configured to receive control commands manually entered into the input device and to adjust the length of the at least five gripper arms as a function of the control commands.

11. The handling system according to claim 1 wherein the gripping device comprises a load situation identifier for identifying a load situation when the gripping arms are coupled to the reinforcement cage and bear at least part of its weight, wherein an electronic control device communicates with the load situation identifier and is configured to prevent the adjustment of the length of the at least five gripper arms for as long as the at least five gripper arms are coupled to the reinforcement cage and bear at least part of its weight.

12. The handling system according to claim 3, wherein at least one of the electronic control device and the input device comprises an emergency stop switch, and the electronic control device is configured to stop the motor from causing the telescopic adjustment of the at least five gripper arms when the emergency stop switch is switched.

13. The handling system according to claim 1 wherein the gripping device comprises means for identifying a load-related change in length of the at least five gripper arms, wherein an electronic control device communicates with the means for identifying a load-related change in length and is configured to compensate for this change in length by readjusting the at least five gripper arms.

14. The handling system according to claim 1, wherein the at least five gripper arms, respectively, comprise several joints that move relative to each other by a chain drive.

15. The handling system according to claim 1, wherein the at least five gripper arms, respectively, comprise several joints that move relative to each other by a rack and pinion pair.

16. The handling system according to claim 1, wherein the at least five gripper arms, respectively, comprise several joints that move relative to each other by a moving spindle drive.

17. The handling system according to claim 1, wherein the ends of the plurality of spokes include coupling joints that are configured to swivel to couple to the rods.

18. The handling system according to claim 1, the plurality of spokes includes a first set of spokes in a first plane and second set of spokes in a second plane.

* * * * *